US009141086B1

(12) United States Patent
Rohrbach

(10) Patent No.: US 9,141,086 B1
(45) Date of Patent: Sep. 22, 2015

(54) MAGNETIC ACTUATED ATTACHMENT MECHANISMS FOR WEARABLE DEVICES

(71) Applicant: Apple Inc., Cupertino, CA (US)

(72) Inventor: Matthew D. Rohrbach, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/580,319

(22) Filed: Dec. 23, 2014

Related U.S. Application Data

(60) Provisional application No. 62/035,679, filed on Aug. 11, 2014.

(51) Int. Cl.

| | |
|---|---|
| ***G04B 37/14*** | (2006.01) |
| ***G04B 37/00*** | (2006.01) |
| ***A44C 5/20*** | (2006.01) |
| *A44C 5/14* | (2006.01) |

(52) U.S. Cl.
CPC ..... *G04B 37/0008* (2013.01); *A44C 5/20* (2013.01); *A44C 5/14* (2013.01); *G04B 37/1486* (2013.01)

(58) Field of Classification Search
CPC ..... A44C 5/14; A44C 5/145; G04B 37/1486; G04B 37/16; Y10T 24/32; E05B 47/0038
USPC ..... 224/152, 164–180; 368/282; 24/303, 24/265 WS; 70/276
See application file for complete search history.

(56) References Cited

U.S. PATENT DOCUMENTS

| | | | | |
|---|---|---|---|---|
| 2,615,227 | A * | 10/1952 | Hornik | 24/303 |
| 3,744,833 | A * | 7/1973 | Berducone | 292/251.5 |
| 4,280,214 | A * | 7/1981 | Kunii et al. | 368/282 |
| 4,941,236 | A * | 7/1990 | Sherman et al. | 24/303 |
| 5,076,623 | A | 12/1991 | Richards | |
| 5,323,516 | A | 6/1994 | Hartmann | |
| 5,367,891 | A * | 11/1994 | Furuyama | 63/29.2 |
| 5,889,737 | A * | 3/1999 | Alameh et al. | 368/204 |
| 6,598,271 | B2 * | 7/2003 | Nire | 24/303 |
| 6,598,272 | B2 * | 7/2003 | Nire | 24/303 |
| 6,981,391 | B2 * | 1/2006 | Suzuki | 63/3.1 |
| 7,043,740 | B2 | 5/2006 | Chen et al. | |
| 7,152,282 | B2 * | 12/2006 | Costa | 24/303 |
| 7,441,424 | B2 * | 10/2008 | Saitoh et al. | 70/19 |
| 8,467,270 | B2 | 6/2013 | Gossweiler, III et al. | |
| 8,505,334 | B2 * | 8/2013 | Niikura | 63/5.1 |
| 8,997,318 | B2 * | 4/2015 | Nicolas et al. | 24/303 |
| 2005/0128883 | A1 * | 6/2005 | Kraus et al. | 368/281 |
| 2006/0096070 | A1 * | 5/2006 | Ishida | 24/303 |
| 2006/0174455 | A1 * | 8/2006 | Saitoh et al. | 24/303 |
| 2013/0176091 | A1 | 7/2013 | Lancaster-Larocque | |
| 2013/0227987 | A1 | 9/2013 | Wishart | |
| 2014/0000312 | A1 | 1/2014 | Nicolas et al. | |
| 2014/0033482 | A1 | 2/2014 | Fullerton et al. | |
| 2014/0077910 | A1 | 3/2014 | Chaizy | |
| 2014/0191830 | A1 | 7/2014 | Fullerton et al. | |

* cited by examiner

*Primary Examiner* — Sean Kayes

(74) *Attorney, Agent, or Firm* — Brownstein Hyatt Farber Schreck, LLP

(57) ABSTRACT

A band for a wearable device includes first and second band links. The first band link includes one or more magnetic pins and the second band link includes one or more magnets and one or more apertures. In a first position, the first and second band links mechanically and magnetically couple by the magnet pulling the magnetic pin into the aperture. In a second position, the first and second band links mechanically and magnetically decouple by the magnetic pin being forced from the aperture. In this way, the band links may be easily and quickly coupled to and/or decoupled from each other.

15 Claims, 13 Drawing Sheets

MAGNETIC ACTUATED ATTACHMENT MECHANISMS FOR WEARABLE DEVICES

CROSS-REFERENCE TO RELATED APPLICATION

This application is a nonprovisional patent application of and claims the benefit to U.S. Provisional Patent Application No. 62/035,679, filed Aug. 11, 2014 and titled "Magnetic Actuated Attachment Mechanisms for Wearable Devices," the disclosure of which is hereby incorporated herein by reference in its entirety.

TECHNICAL FIELD

This disclosure relates generally to magnetic actuated attachment mechanisms, and more specifically to magnetic actuated attachment mechanisms for wearable devices.

BACKGROUND

Electronic devices and other apparatuses, such as wearable devices like heart rate monitors or fitness monitors, may be attached to one or more body parts of a user utilizing attachment structures such as bands. In order to attach an electronic device to and/or detach the electronic from the user's body part, the attachment structures may include a variety of different coupling mechanisms.

Though a variety of different coupling mechanisms for attachment structures such as bands have been developed, many may not be well suited to the frequency with which a wearable device or other electronic device may be attached to and/or detached from a user (as well as coupling/decoupling of attachment structures to the electronic device, coupling/decoupling of one or more portions of the attachment structures to one or more other portions of the attachment structures, and so on). Use of such coupling mechanisms may be burdensome and/or annoying to users. As a result, use of the wearable device or other electronic device may also be burdensome and/or annoying to users.

SUMMARY

The present disclosure describes systems, methods, and apparatuses related to magnetic actuated attachment mechanisms for wearable devices. A band for a wearable device may include first and second band links. The first band link may include one or more magnetic pins. The second band link may include one or more magnets and one or more apertures. In a first position the first and second band links may mechanically and magnetically couple by the magnet pulling the magnetic pin into the aperture and in a second position the first and second band links may mechanically and magnetically decouple by the magnetic pin being forced from the aperture. In this way, the band links may be easily and quickly coupled to and/or decoupled from each other.

A variety of mechanisms may be included that force the magnetic pin from the aperture in the second position. Such mechanisms may include repulsion between the magnetic pin and the magnet, springs, inner magnets, and/or other components.

Mechanically and magnetically coupling the first and second band links may also electrically connect the first and second band links. Such electrical connection between the first and second band links may electrically connect one or more components of such band links, other band links, the wearable device or other electronic device, and so on.

In various embodiments, a band for a wearable device may include a first band link including a magnetic pin and a second band link including a magnet and an aperture. The first band link and the second band link may: mechanically and magnetically couple in a first position by the magnet pulling the magnetic pin into the aperture and mechanically and magnetically decouple in a second position by the magnetic pin being forced from the aperture.

In some embodiments, a band for a wearable device may include a band section and a clasp. At least one of the band section or the clasp may include a magnetic pin. At least one of the band section or the clasp may include a magnet and an aperture. The band section and the clasp may mechanically and magnetically couple in a first position by the magnet pulling the magnetic pin into the aperture. The band section and the clasp may mechanically and magnetically decouple in a second position by the magnetic pin being forced from the aperture.

In one or more embodiments, a wearable device may include a band section and a band mount coupled to the wearable device. At least one of the band section or the band mount may include a pin. At least one of the band section or the band mount may include an aperture. The band section and the band mount may electrically couple in a first position by the pin into pulling into the aperture. The band section and the band mount may electrically decouple in a second position by the pin being forced from the aperture It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

Figure 1:
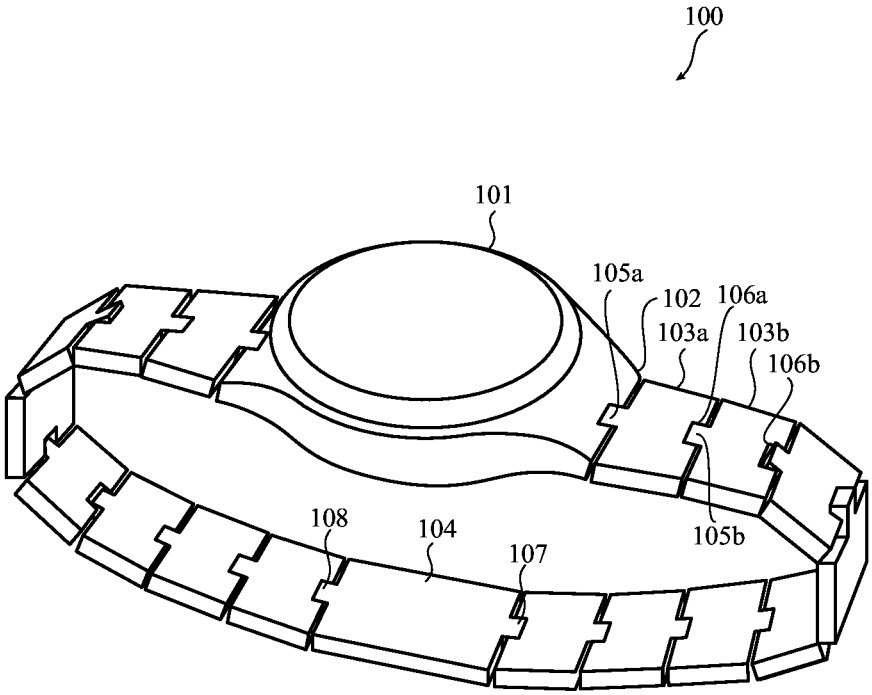
FIG. 1 is an isometric view of an example system including a wearable device and a band including multiple links.

The description that follows includes sample systems, methods, and apparatuses that embody various elements of the present disclosure. However, it should be understood that the described disclosure may be practiced in a variety of forms in addition to those described herein.

The present disclosure describes systems, methods, and apparatuses related to magnetic actuated attachment mechanisms for wearable devices. A band (or other attachment structure) for a wearable device may include first and second band links (or other portions). The first band link may include one or more magnetic pins and the second band link may include one or more magnets and one or more apertures. In a first position, the first and second band links may mechanically and magnetically couple by the magnet pulling the magnetic pin into the aperture. In a second position, the first and second band links may mechanically and magnetically decouple by the magnetic pin being forced from the aperture. In this way, the band links may be easily and quickly coupled to and/or decoupled from each other.

Although these coupling mechanisms are described as coupling/decoupling band links, it is understood that this is an example. In various implementations such coupling mechanisms may be utilized to couple/decouple an attachment structure and a wearable device or other electronic device, multiple portions of an attachment structure (such as when such coupling mechanisms are included in a clasp of a band), and so on.

The first and/or second band links may include a variety of mechanisms that force the magnetic pin from the aperture in the second position. Such mechanisms may include repulsion between the magnetic pin and the magnet. Such mechanisms may also include springs, inner magnets, and/or other components of the first band link that pull the magnetic pin from the aperture in the second position.

Mechanically and magnetically coupling the first and second band links may also electrically connect the first and second band links (as well as one or more components of such band links, other band links, the wearable device or other electronic device, and so on). In some implementations, the magnetic pin and the magnet may be conductive. In other implementations, the magnetic pin and magnet may each include conductive material that is insulated by insulating material and electrically connects in the first position. In various implementations, coupling and/or decoupling of the first and second band links may cause a state change in the wearable device or other electronic device.

The band may be switched between the first and second positions by altering the position of the first and second band links with respect to each other. However, in various implementations the first and second positions may refer to aspects other than the position of the first and second band links with respect to each other. For example, the first and/or second band link may include mechanisms such as a lever that switch the band between the first and the second position by performing actions such as rotating the magnet and/or the magnetic pin. By way of another example, the band may be switched between the first and second positions utilizing a tool, such as a tool that is operable to rotate the magnet and/or the magnetic pin. Various configurations are possible and contemplated.

FIG. 1 is an isometric view of an example system 100 including a wearable device 101 and a band with multiple links (including first band link 103*a* and second band link 103*b*. As illustrated, in this example the band includes two portions of links that are joined by a clasp 104. As also illustrated, the links each include a tongue (such as the tongues 105*a* and 105*b*) and a notch (such as the notches 106*a* and 106*b*). The tongues may be inserted into the notches of other links (and/or band mounts or other attachment portions 102 of the wearable device, attachment portions of the clasp, and so on) for coupling. The links may be modular such that their position in the band may be rearranged. The links and/or the band may be formed of a variety of different materials such as one or more metals, plastics, rubbers, and/or other materials.

Further, as illustrated the clasp 104 may include tongues 107 and 108 that are insertable into notches of various links for coupling. However, it is understood that this is an example and that the clasp may couple/decouple to links utilizing variously configured components and mechanisms.

Additionally, it is understood that the system 100 is an example. As illustrated, the wearable device 101 is a digital wristwatch. However, in various implementations the band may be utilized with various other wearable devices and/or any kind of electronic device without departing from the scope of the present disclosure such as tablet computers, smart phones, laptop computers, and so on. Moreover, although a band including links is illustrated, it is understood that other kinds of attachments structures may be utilized without departing from the scope of the present disclosure such as a solid band, a band with two solid halves instead of links or other kind of band sections, and/or any other attachment structure.

Figure 2A:
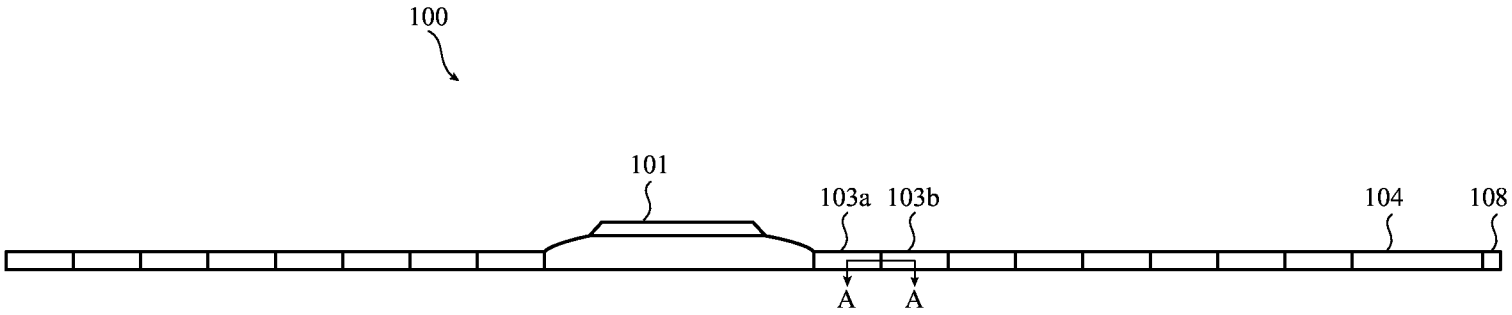
FIG. 2A is a side view of the example system of FIG. 1 after the clasp of the band has been decoupled and the band laid flat such that first and second band links are in a first position with respect to each other.

FIG. 2A is a side view of the example system 100 of FIG. 1 after the clasp 104 of the band has been decoupled and the band laid flat such that first and second band links 103*a* and 103*b* are in a first position with respect to each other. In this first position, the first and second band links may be mechanically and magnetically coupled.

Figure 2B:
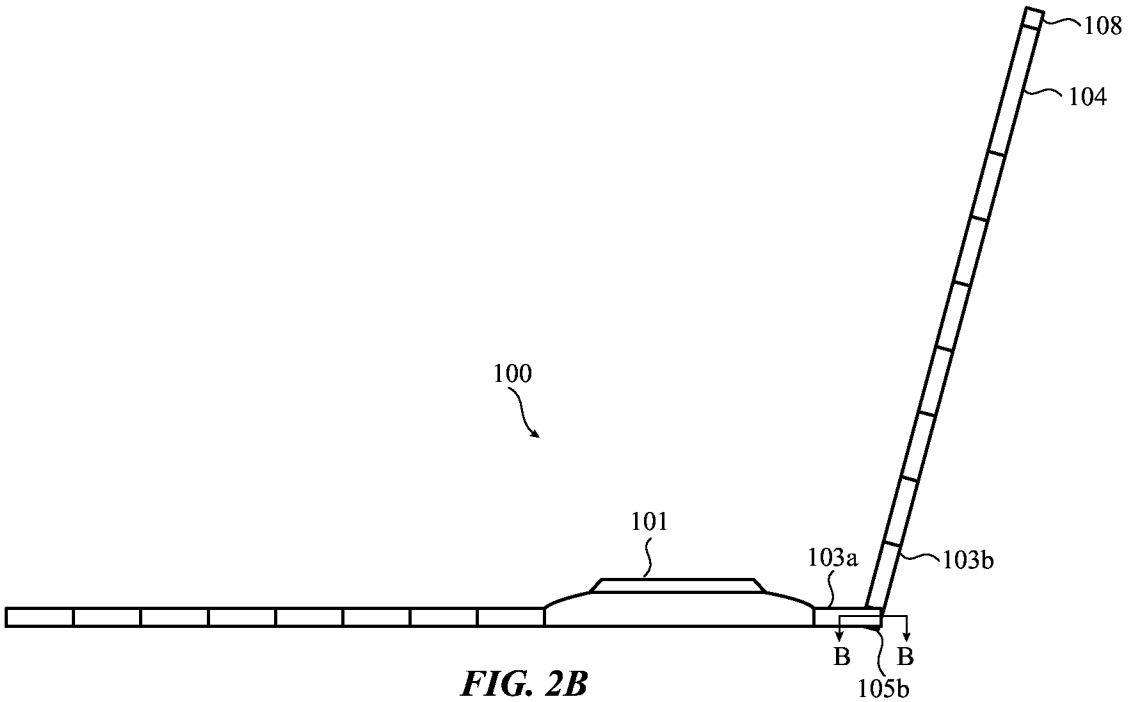
FIG. 2B illustrates the view of FIG. 2A after the second band link has been altered such that the first and second band links are in a second position with respect to each other.
Figure 2C:
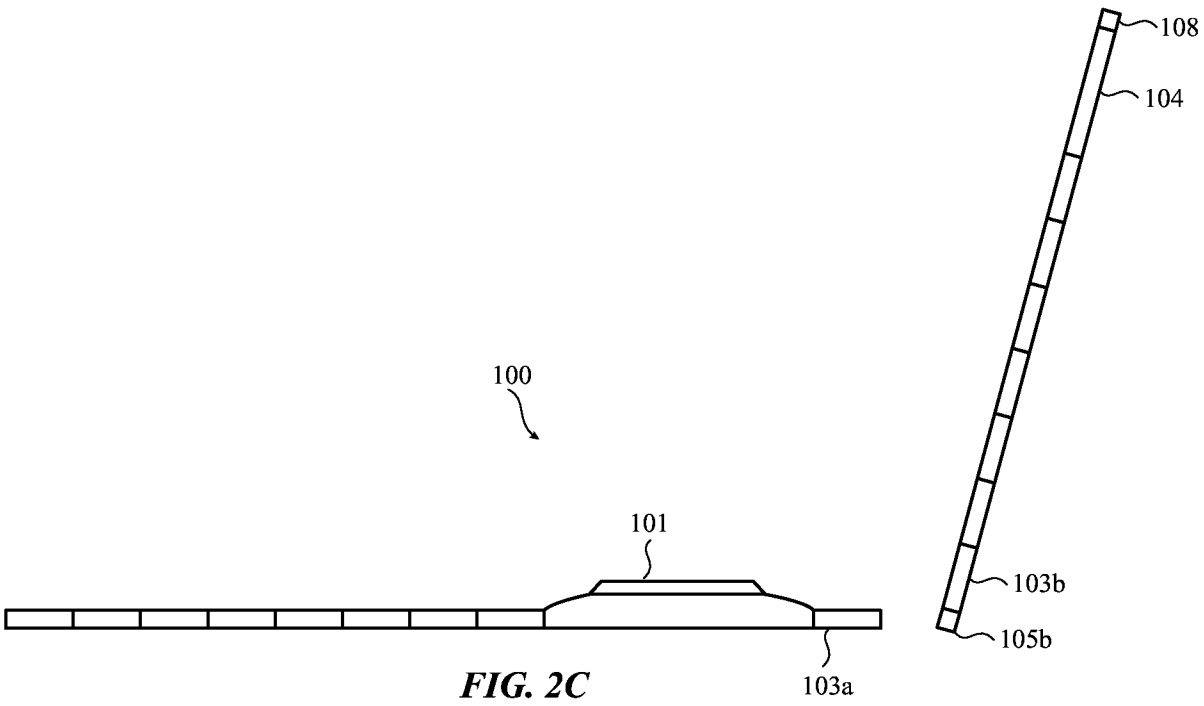
FIG. 2C illustrates the view of FIG. 2B after the first and second band links have been separated from each other.

FIG. 2B illustrates the view of FIG. 2A after the second band link 103*b* has been altered such that the first and second band links 103*a* and 103*b* are in a second position with respect to each other. In this second position, the first and second band links may be mechanically and magnetically decoupled. As such, the first and second band links may be separated. FIG. 2C illustrates the view of FIG. 2B after the first and second band links have been separated from each other.

Although the first and second positions are illustrated in FIGS. 2A and 2B as single positions, it is understood that this is an example. The first and second band links 103*a* and 103*b* may be moveable with respect to each other (such as rotated and/or otherwise moved) across a range of motion. In such implementations, the first position may correspond to a first portion of the range of motion and the second position may correspond to the second range of motion. The first portion may be larger than the second range of motion such that the band has flexibility during use while the links remain coupled. For example, the first range may be the motion illustrated in the difference between FIGS. 1 and 2A whereas the second range may be the motion illustrated in the difference between FIG. 2A and FIG. 2B.

The motion illustrated in the difference between FIG. 2A and FIG. 2B may not be accomplished while the wearable device 101 is worn. As such, the first and second band links 103*a* and 103*b* may remain coupled while the wearable device is worn yet still being capable of easy and quick decoupling while the wearable device is not worn.

Figure 3A:
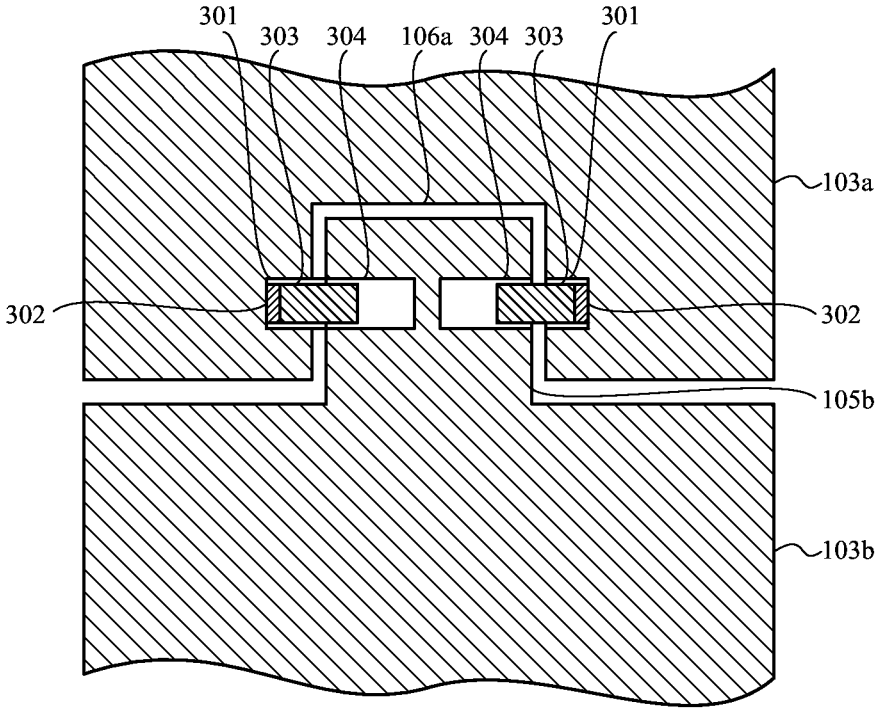
FIG. 3A is a cross sectional view of the first and second band links of FIG. 2A taken along the line A-A of FIG. 2A in accordance with a first example implementation.

FIG. 3A is a cross sectional view of the first and second band links 103*a* and 103*b* in the first position of FIG. 2A taken along the line A-A of FIG. 2A in accordance with a first example implementation. As illustrated, in this first example implementation the tongue 105*b* may include magnetic pins 303 that are configured to move within apertures 304 and the notch 106*a* may include apertures 301 having magnets 302. As also illustrated, in the first position the magnets may pull the magnetic pins into the apertures 301 such that the magnetic pins are positioned between the first and second band links, mechanically and magnetically coupling the first and second band links.

Figure 3B:
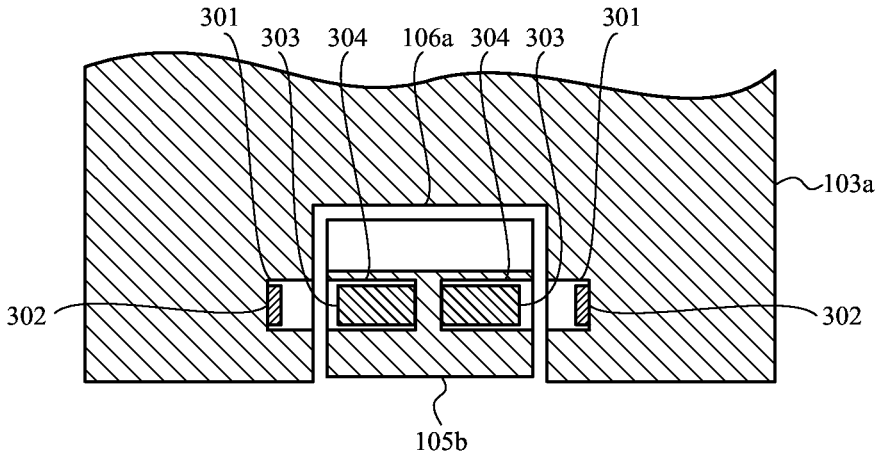
FIG. 3B is a cross sectional view of the first and second band links of FIG. 2B taken along the line B-B of FIG. 2B in accordance with the first example implementation.

FIG. 3B is a cross sectional view of the first and second band links 103*a* and 103*b* in the second position of FIG. 2B taken along the line B-B of FIG. 2B in accordance with the first example implementation. As illustrated, in the second position the magnetic pins 303 may be forced from the apertures 301 such that the magnetic pins are not positioned between the first and second band links, mechanically and magnetically decoupling the first and second band links.

In this first example implementation, magnetic attraction between the magnetic pins 303 and the magnets 302 may pull the magnetic pins into the apertures 301 in the first position and magnetic repulsion between the magnetic pins and the magnets may force the magnetic pins from the apertures 301 in the second position. This difference between magnetic attraction and repulsion of the magnetic pins and the magnets may relate to associated polarity patterns of the magnetic pins and the magnets and rotation of the magnetic pins and/or the magnets caused by switching between the first and second positions. For example, moving the first and second band links 103*a* and 103*b* with respect to each other may rotate the magnetic pins and/or the magnets with respect to each other.

Figure 4A:
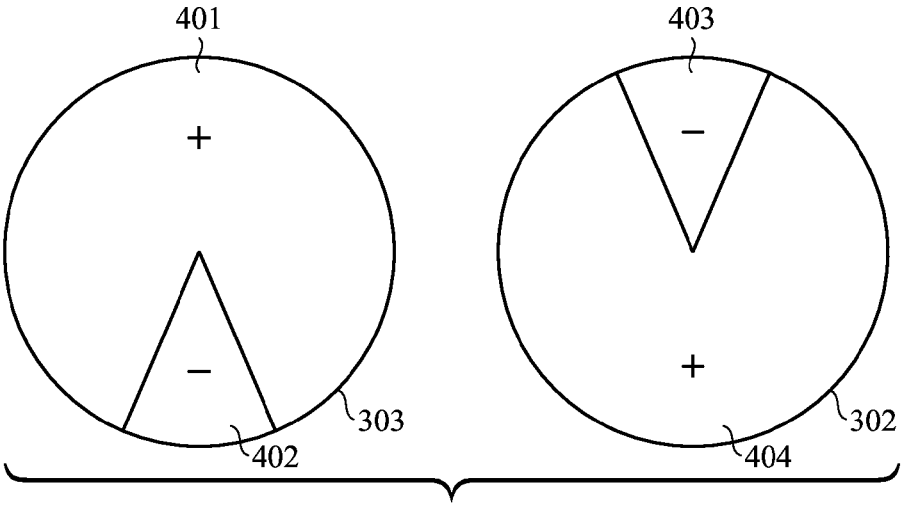
FIG. 4A is a diagram illustrating example associated polarity patterns of the magnetic pins and the magnets corresponding to their positions in FIG. 3A.

For example, FIG. 4A is a diagram illustrating example associated polarity patterns of the magnetic pins 303 and the magnets 302 corresponding to their positions in FIG. 3A. The surfaces shown of the magnetic pins and the magnets may be the surfaces that face each other in FIG. 3A. As illustrated, the positive portion 401 and negative portion 402 of the magnetic pins may not be directly aligned with the positive 404 and negative portion 403 of the magnets. As such, the magnets may attract the magnetic pins.

Figure 4B:
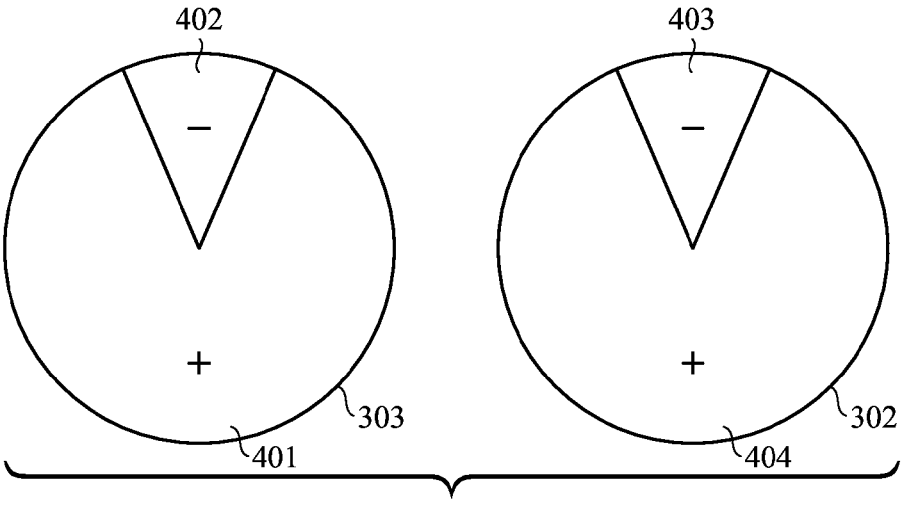
FIG. 4B is a diagram illustrating example associated polarity patterns of the magnetic pins and the magnets corresponding to their positions in FIG. 3B.

Similarly, FIG. 4B is a diagram illustrating example associated polarity patterns of the magnetic pins 303 and the magnets 302 corresponding to their positions in FIG. 3B. The surfaces shown of the magnetic pins and the magnets may be the surfaces that face each other in FIG. 3B. As illustrated, the positive portion 401 and negative portion 402 of the magnetic pins may be directly aligned with the positive 404 and negative portion 403 of the magnets. As such, the magnets may not attract and/or repel the magnetic pins.

Although a particular configuration of positive and negative portions 401-404 is illustrated in FIGS. 4A-4B, it is understood that this is an example. Other configurations or codings of the magnetic pins 303 and magnets 302 are possible and contemplated without departing from the scope of the present disclosure. For example, in various implementations the positive and negative portions may be reversed.

Additionally, as illustrated the positive portions 401 and 404 of the magnetic pins 303 and the magnets 302 constitute an unequal portion of the magnetic pins and the magnets as compared to the negative portions 402 and 403. This may result in the magnetic pins and magnets having a greater range of motion where they can be rotated with respect to each other while still attracting than the range of motion where they can be rotated with respect to each other and not attract and/or repel. However, although specific proportions are shown, it is understood that this is an example and that other configurations or codings of the magnetic pins and/or magnets are possible and contemplated without departing from the scope of the present disclosure. For example, though the positive and negative portions are shown with the negative portions being substantially wedge-shaped areas occupying approximately 25% of the surfaces, in various examples the positive and negative portions may be divided into various shaped portions of various sizes, such as implementations with equal sized half-circle shaped portions, implementations with the positive portions being substantially wedge-shaped areas occupying approximately 25% of the surfaces, and/or other configurations of proportions and arrangement patterns.

Further, in some implementations the magnetic pins 303 and the magnets 302 may be coded such that the attraction and/or repulsion between the magnetic pins and the magnets changes as the magnetic pins and magnets are moved (such as rotated) with respect to each other. For example, the magnetic pins and the magnets may be coded such that the attraction and/or repulsion increases between the magnetic pins and the magnets as they are rotated with respect to each other. Such gradation of magnetic strength may allow disconnection and/or connection to be more gradual as opposed to abrupt. Such gradation of magnetic strength may also allow simulation of the feeling or impression to a user of unscrewing band links (such as first and second band links 103*a* and 103*b*) from each other.

Moreover, this first example is illustrated and described as forcing the magnetic pins 303 from the apertures 301 in the second position utilizing magnetic repulsion between the magnetic pins and the magnets 302. However, in other implementations other mechanisms may be utilized to aid such magnetic repulsion in forcing the magnetic pins from the apertures 301, force the magnetic pins from the apertures 301 when the magnets are not attracting the magnetic pins, and/or overcome the magnetic attraction between the magnetic pins and the magnets to force the magnetic pins from the apertures 301.

Figure 5:
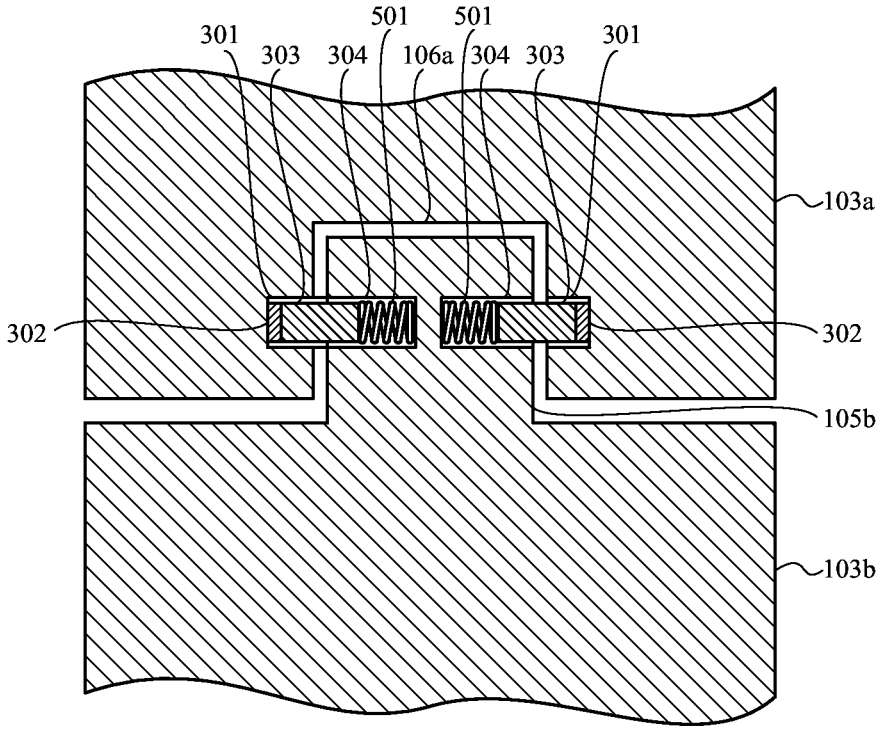
FIG. 5 is a cross sectional view of the first and second band links of FIG. 2A taken along the line A-A of FIG. 2A in accordance with a second example implementation.

FIG. 5 is a cross sectional view of the first and second band links 103*a* and 103*b* of FIG. 2A taken along the line A-A of FIG. 2A in accordance with a second example implementation. As illustrated, this second example implementation may include springs 501 that bias the magnetic pins 303 away from the apertures 301. As such, the magnetic attraction may overcome the force of the springs, stretching the springs, in the first position to pull the magnetic pins into the apertures 301 and the stretched springs may pull the magnetic pins out of the apertures 301 in the second position when the magnets no longer attract and/or repel the magnetic pins.

Figure 6:
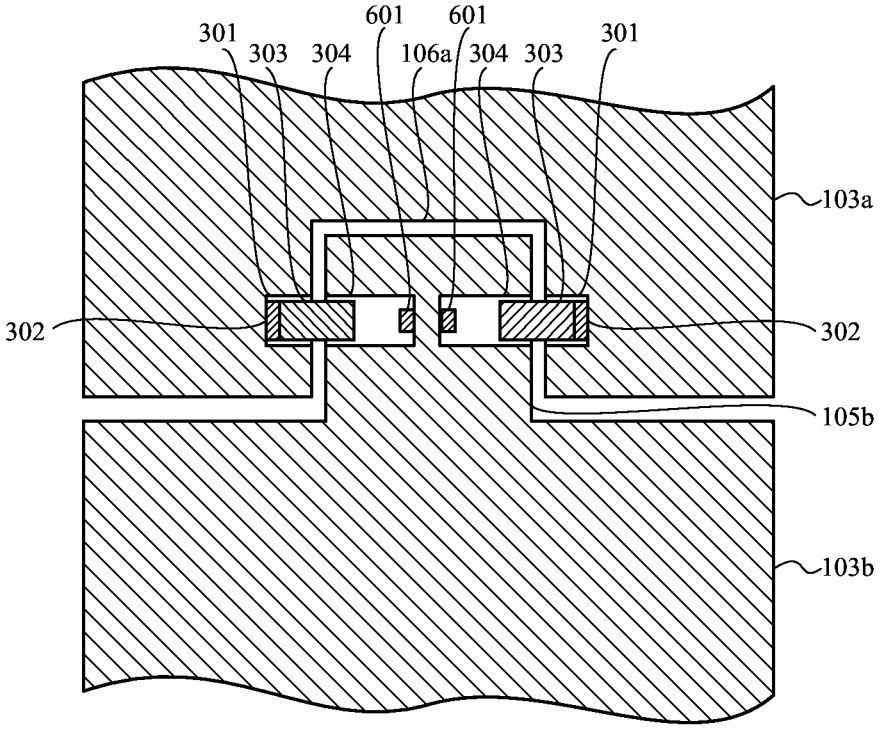
FIG. 6 is a cross sectional view of the first and second band links of FIG. 2A taken along the line A-A of FIG. 2A in accordance with a third example implementation.

FIG. 6 is a cross sectional view of the first and second band links of FIG. 2A taken along the line A-A of FIG. 2A in accordance with a third example implementation. As illustrated, this third example implementation may include inner magnets 601 that attract the magnetic pins 303 into the apertures 304 and away from the apertures 301. However, the magnetic attraction between the magnets and the magnetic pins may be stronger in the first position than the magnetic attraction between the inner magnets and the magnetic pins (such as where the magnets are large than the inner magnets, where the magnets have a stronger magnetic field than the inner magnets, are coded to more strongly attract the magnetic pins, and so on). As such, the magnetic attraction between the magnets and the magnetic pins may overcome the magnetic attraction between the inner magnets and the magnetic pins in the first position to pull the magnetic pins into the apertures 301 and the magnetic attraction between the inner magnets and the magnetic pins may pull the magnetic pins out of the apertures 301 in the second position when the magnets no longer attract and/or repel the magnetic pins.

Figure 7:
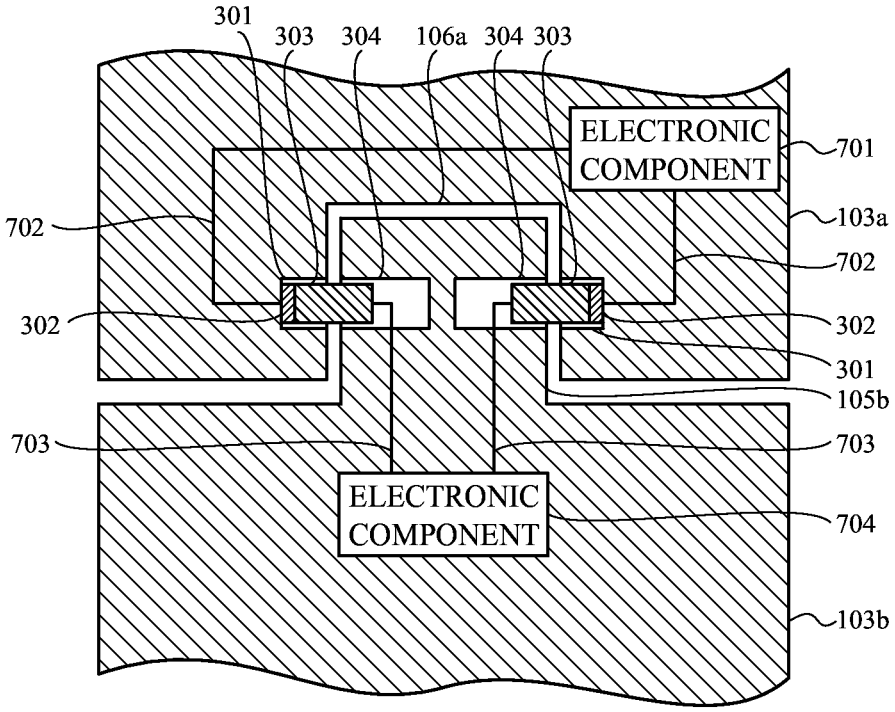
FIG. 7 is a cross sectional view of the first and second band links of FIG. 2A taken along the line A-A of FIG. 2A in accordance with a fourth example implementation.

FIG. 7 is a cross sectional view of the first and second band links 103A and 103B of FIG. 2A taken along the line A-A of FIG. 2A in accordance with a fourth example implementation. As illustrated, in this fourth example implementation, mechanically and magnetically coupling the first and second band links may also electrically couple the first and second band links. As illustrated, electrically coupling the first and second band links may electrically couple one or more electronic components 701 and 704 via conductive components 702 and 703, such as wires. However, it is understood that this is an example and that in various implementations electrically coupling the first and second band links may electrically couple one or more of the first and/or second band links to other band links, the wearable device 101, other electronic devices, and so on without departing from the scope of the present disclosure.

In some implementations, the magnetic pins 303 and the magnets 302 may be conductive. As such, contact between the magnetic pins and the magnets when the magnetic pins and the magnets are magnetically coupled may electrically connect the electronic components 701 and 704 via conductive components 702 and 703.

In other implementations, the magnetic pins 303 and magnets 302 may each include conductive material that is insulated by insulating material and contacts to electrically connect in the first position. As such, between the magnetic pins and the magnets when the magnetic pins and the magnets are magnetically coupled may electrically connect the electronic components 701 and 704 via conductive components 702 and 703. For example, the magnetic pins and magnets may each include conductive centers that align with each other while the materials surrounding the centers are insulating (which may be magnetic portions of the magnetic pins and/or magnets and/or insulating materials that are surrounded by magnetic portions of the magnetic pins and/or magnets, and so on).

In various implementations, coupling and/or decoupling of the first and second band links 103*a* and 103*b* may cause a state change in the wearable device 101 or other electronic device. For example, coupling the first and second band links may cause an interrupt signal to be transmitted to a processing unit of the wearable device that wakes the wearable device from a sleep state whereas decoupling the first and second band links may cause an interrupt signal to be transmitted to the processing unit that puts the wearable device into the sleep state. By way of another example, coupling the first and second band links may cause the wearable device to provide a notification (such as a visual, audio, haptic, and/or other notification) regarding the coupling whereas decoupling the first and second band links may cause the wearable device to provide a notification regarding the decoupling.

The electronic components 701 and 704 may be any kind of electronic components. Such components may include one or more processing units, one or more communication components, one or more electrical interconnects, one or more input/output components (such as one or more microphones, speakers, haptic components, displays, touch screens, touch pads, touch sensors, force sensors, and so on), and one or more non-transitory storage media (which may take the form of, but is not limited to, a magnetic storage medium; optical storage medium; magneto-optical storage medium; read only memory; random access memory; erasable programmable memory; flash memory; and so on). Additionally, the wearable device 101 may also include one or more of these components.

Although FIGS. 2A-2C illustrate that the band may be switched between the first and second positions by altering the position of the first and second band links 103*a* and 103*b* with respect to each other, it is understood that this is an example. In various implementations the first and second positions may refer to aspects other than the position of the first and second band links with respect to each other.

Figure 8:
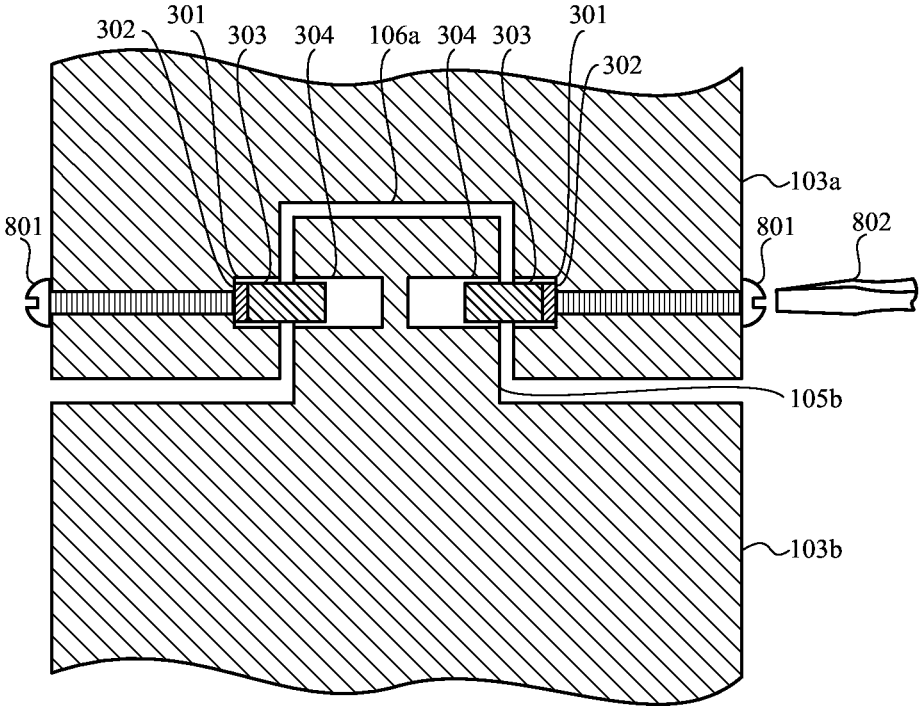
FIG. 8 is a cross sectional view of the first and second band links of FIG. 2A taken along the line A-A of FIG. 2A in accordance with a fifth example implementation.

For example, FIG. 8 is a cross sectional view of the first and second band links 103*a* and 103*b* of FIG. 2A taken along the line A-A of FIG. 2A in accordance with a fifth example implementation. In this fifth example implementation, the band may be switched between the first and second position utilizing a tool 802.

As illustrated, the first band link 103*a* includes screws 801 in this fifth example implementation that are operable to rotate the magnets 302 when manipulated by a screwdriver 802. As such, rotation of the magnets may switch the band between the first and second position by transitioning the magnets between positions where the magnets attract the magnetic pins 303 and positions where the magnets do not attract and/or repel the magnetic pins.

However, it is understood that this is an example. In various implementations, the tool 802 may be a tool other than a screwdriver. Further, in various implementations the tool may operate on a component other than a screw 801, a component of the first and/or second band link 103*a* and 103*b* other than the magnets 302, a component of the second band link 103*b* instead of and/or in addition to a component of the first band link 103*a*, and so on. Other configurations are possible and contemplated without departing from the scope of the present disclosure.

Figure 9:
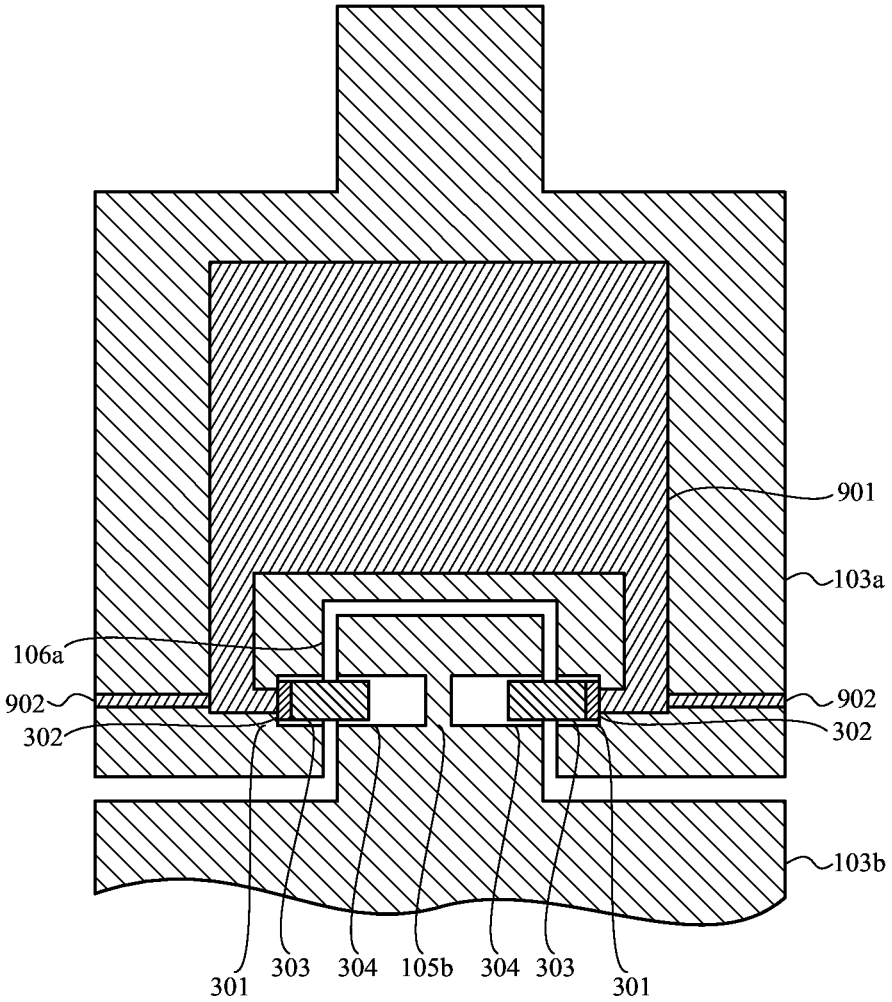
FIG. 9 is a cross sectional view of the first and second band links of FIG. 2A taken along the line A-A of FIG. 2A in accordance with a sixth example implementation.

By way of another example, FIG. 9 is a cross sectional view of the first and second band links 103*a* and 103*b* of FIG. 2A taken along the line A-A of FIG. 2A in accordance with a sixth example implementation. In this sixth example implementation, the band may be switched between the first and second position utilizing a mechanism 901.

As illustrated, the first band link 103*a* includes a lever 901 that is pivotally mounted to the first band link via pins 902 in this sixth example implementation. Movement of the lever may rotate the magnets 302. As such, rotation of the magnets may switch the band between the first and second position by transitioning the magnets between positions where the magnets attract the magnetic pins 303 and positions where the magnets do not attract and/or repel the magnetic pins.

However, it is understood that this is an example. In various implementations, the mechanism 901 may be a mechanism other than a lever, operate on a component of the first and/or second band link 103*a* and 103*b* other than the magnets 302, be a component of the second band link instead of and/or in addition to the first band link, and so on. Other configurations are possible and contemplated without departing from the scope of the present disclosure.

Additionally, although the coupling mechanisms illustrated in FIGS. 2A-9 and described above are discussed as coupling/decoupling the first and second band links 103*a* and 103*b*, it is understood that this is an example. In various implementations such coupling mechanisms may be utilized to couple one or more links to and/or decouple one or more links from attachment portions 102 of the wearable device, couple the clasp 104 to and/or decouple the clasp from one or more links and/or attachment portions of the wearable device, and so on. Other configurations are possible and contemplated without departing from the scope of the present disclosure.

Figure 10:
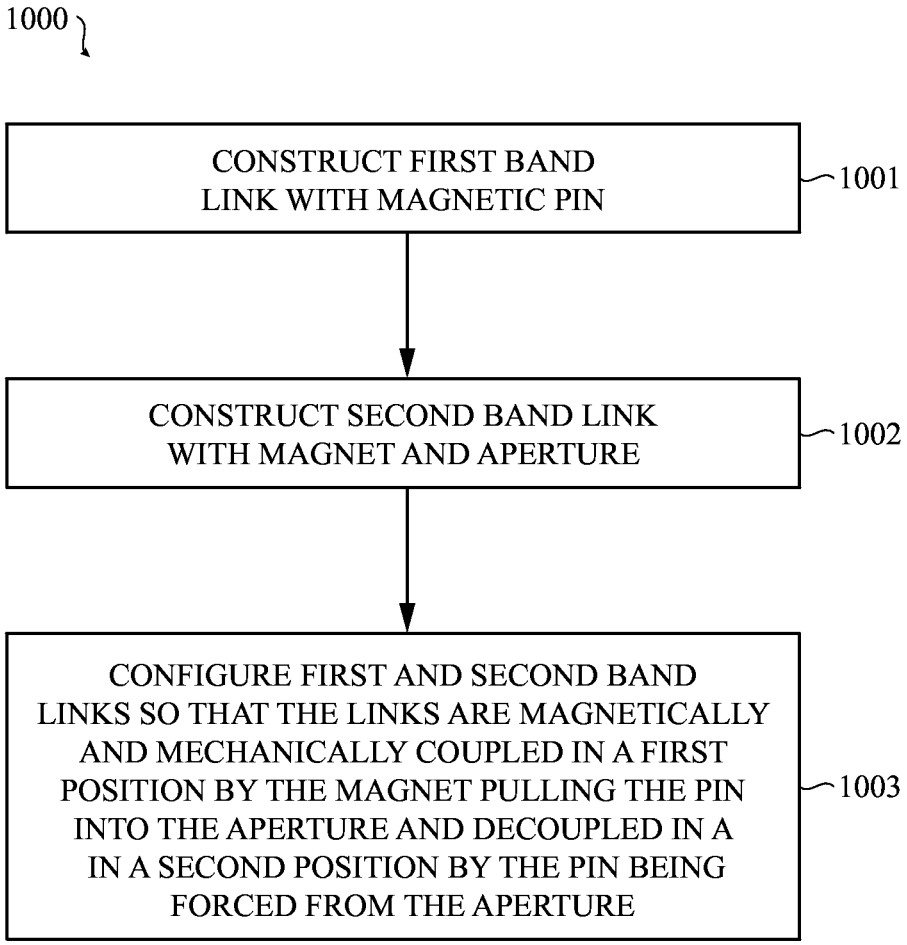
FIG. 10 is a flow chart illustrating an example method for assembling an attachment structure. This method may assemble the example systems of FIGS. 1-9.

FIG. 10 is a flow chart illustrating an example method 1000 for assembling an attachment structure. This method may assemble the example systems of FIGS. 1-9.

The flow may begin at block 1001 where a first band link is constructed with a magnetic pin. The flow may then proceed to block 1002 where a second band link is constructed with a magnet and an apertures.

Next, the flow may proceed to block 1003 where the first and second band links are configured so that the first and second band links are mechanically and magnetically coupled in a first position and mechanically and magnetically decoupled in a second position. The first and second band links may be mechanically and magnetically coupled in the first position by pulling the magnetic pin into the aperture. The first and second band links may be mechanically and magnetically decoupled in the second position by forcing the magnetic pin from the aperture.

Although the method 1000 is illustrated and described above as including particular operations performed in a particular order, it is understood that this is an example. In various implementations, various orders of the same, similar, and/or different operations may be performed without departing from the scope of the present disclosure.

For example, the method 1000 illustrates and describes the operation of configuring the first and second band links to mechanically and magnetically couple in the first position and mechanically and magnetically decouple in the second position as separate operations from constructing the first and second band links, all of which are illustrated and described as being performed in a linear order. However, it is understood that this is an example and that in various implementations one or more of blocks 1001-1003 may be performed simultaneously without departing from the scope of the present disclosure.

As discussed above and illustrated in the accompanying figures, the present disclosure describes systems, methods, and apparatuses related to magnetic actuated attachment mechanisms for wearable devices. A band (or other attachment structure) for a wearable device may include first and second band links (or other portions). The first band link may include one or more magnetic pins and the second band link may include one or more magnets and one or more apertures. In a first position, the first and second band links may mechanically and magnetically couple by the magnet pulling the magnetic pin into the aperture. In a second position, the first and second band links may mechanically and magnetically decouple by the magnetic pin being forced from the aperture. In this way, the band links may be easily and quickly coupled to and/or decoupled from each other.

In the present disclosure, the methods disclosed may be implemented utilizing sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

Techniques of the described disclosure may utilize a computer program product, or software, that may include a non-transitory machine-readable medium having stored thereon instructions, which may be used to program a computer system (or other electronic devices) to perform a process according to the present disclosure, such as a computer controlled manufacturing method. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

I claim:

1. A band for a wearable device, comprising:

a first band link including a magnetic pin; and a second band link including a magnet and an aperture;

wherein the first band link and the second band link:

mechanically and magnetically couple in a first position by the magnet pulling the magnetic pin into the aperture and partially out from the first band link; and mechanically and magnetically decouple in a second position by the magnetic pin being forced from the aperture; wherein:

the magnetic pin and the aperture are perpendicular to a length of the band; and the first band link and second band link are configured to rotate about an axis defined by the magnetic pin and simultaneously maintain a connection between the first band link and the second band link.

2. The band of claim 1, wherein magnetic repulsion between the magnet and the magnetic pin forces the magnetic pin from the aperture in the second position.

3. The band of claim 1, wherein the first band link includes a spring that pulls the magnetic pin from the aperture in the second position.

4. The band of claim 1, wherein the first band link includes an inner magnet that pulls the magnetic pin from the aperture in the second position.

5. The band of claim 4, wherein the inner magnet has a weaker magnetic field than the magnet.

6. The band of claim 1, wherein mechanically and magnetically coupling the first band link and second band link electrically connects at least one of:

the wearable device to the second band link;

the first band link to a third band link;

the first band link to an electronic component of the second band link; or an electronic component of the first band link to the second band link.

7. The band of claim 1, wherein polarities of the magnet and the magnetic pin are configured to attract in the first position and not attract in the second position.

8. The band of claim 7, wherein the polarities of the magnet and the magnetic pin are configured to repel in the second position.

9. The band of claim 1, wherein at least one of the first band link or the second band link are formed of at least one of metal, plastic, or rubber.

10. A band for a wearable device, comprising:

a band section; and a clasp;

wherein:

at least one of the band section or the clasp includes a magnetic pin;

at least one of the band section or the clasp includes a magnet and an aperture;

the band section and the clasp mechanically and magnetically couple in a first position by the magnet pulling the magnetic pin into the aperture and partially out from the clasp or the band section;

the band section and the clasp mechanically and magnetically decouple in a second position by the magnetic pin being forced from the aperture;

the magnetic pin and the aperture are perpendicular to a length of the band; and the band section and clasp are configured to rotate about an axis defined by the magnetic pin and simultaneously maintain a connection between the band section and the clasp.

11. The band of claim 10, wherein the magnetic pin is located in a tongue of the clasp and the aperture is located in a notch of the band section in which the tongue is configured to be inserted.

12. The band of claim 10, wherein the magnetic pin is located in a tongue of the band section and the aperture is located in a notch of the clasp in which the tongue is configured to be inserted.

13. The band of claim 10, wherein the band is switched between the first position and the second position by altering a position of the clasp with respect to the band section.

14. The band of claim 13, wherein the clasp is moveable with respect to the band section across a range of motion and a first portion of the range of motion corresponding to the first position is greater than a second portion of the range of motion corresponding to the second position.

15. The band of claim 10, wherein the band is switched between the first position and the second position utilizing at least one of:

a mechanism of one of the clasp or the band section; or a tool.

* * * * *